US008656988B1

(12) United States Patent
Paul et al.

(10) Patent No.: US 8,656,988 B1
(45) Date of Patent: Feb. 25, 2014

(54) EXTERNAL REINFORCEMENT OF CONNECTIONS BETWEEN HEADER TANKS AND TUBES IN HEAT EXCHANGERS

(75) Inventors: Neal Paul, Worthing, SD (US); Travis Bunde, Lyons, SD (US); Curt Lindstrom, Sioux Falls, SD (US)

(73) Assignee: Adams Thermal Systems, Inc., Canton, SD (US)

( * ) Notice: Subject to any disclaimer, the term of this patent is extended or adjusted under 35 U.S.C. 154(b) by 0 days.

(21) Appl. No.: 13/538,127

(22) Filed: Jun. 29, 2012

Related U.S. Application Data

(62) Division of application No. 12/716,396, filed on Mar. 3, 2010.

(51) Int. Cl.
*F28F 9/16* (2006.01)

(52) U.S. Cl.
USPC ..... 165/178; 165/151; 165/906

(58) Field of Classification Search
USPC ..... 165/151, 178, 906
See application file for complete search history.

(56) References Cited

U.S. PATENT DOCUMENTS

| | | | | |
|---|---|---|---|---|
| 1,943,557 | A * | 1/1934 | Ruthenburg et al. | 165/151 |
| 2,046,791 | A * | 7/1936 | Przyborowski | 165/151 |
| 2,258,041 | A | 10/1941 | Young | |
| 2,840,352 | A * | 6/1958 | Ghai et al. | 165/151 |
| 2,983,483 | A * | 5/1961 | Modine | 165/151 |
| 3,190,352 | A * | 6/1965 | Simpelaar | 165/151 |
| 3,245,465 | A * | 4/1966 | Young | 165/148 |
| 3,433,300 | A * | 3/1969 | Pasternak | 165/151 |
| 3,633,660 | A | 1/1972 | Young | |
| 3,739,840 | A | 6/1973 | Jones | |
| 4,623,017 | A | 11/1986 | Oda | |
| 4,651,821 | A | 3/1987 | Moranne | |
| 5,538,079 | A | 7/1996 | Pawlick | |
| 6,019,169 | A | 2/2000 | Ruppel | |
| 7,143,824 | B2 | 12/2006 | Emrich | |
| 7,413,005 | B2 | 8/2008 | Heine | |
| 7,461,685 | B2 | 12/2008 | Overbury | |
| 7,461,689 | B2 | 12/2008 | Merklein | |
| 2008/0000627 | A1 * | 1/2008 | Noguchi et al. | 165/173 |

FOREIGN PATENT DOCUMENTS

WO WO 2008072859 A1 * 6/2008

* cited by examiner

*Primary Examiner* — Leonard R Leo
(74) *Attorney, Agent, or Firm* — Jeffrey A. Proehl; Woods, Fuller, Shultz & Smith, P.C.

(57) ABSTRACT

A heat exchanger has first and second sides and comprises a pair of tanks, with each of the tanks defining an interior and including a header. A plurality of openings is formed in the header; The heat exchanger comprises a plurality of tubes extending between the openings in the tanks, with each of the tubes having opposite end portions joined to the tanks to fluidly connect the interiors of the tanks through interiors of the tubes. The heat exchanger comprises at least one reinforcement ribbon element extending across a juncture between the header and the plurality of tubes to reinforce a connection between the header and the plurality of tubes.

18 Claims, 7 Drawing Sheets

EXTERNAL REINFORCEMENT OF CONNECTIONS BETWEEN HEADER TANKS AND TUBES IN HEAT EXCHANGERS

BACKGROUND

1. Field

The present disclosure relates to heat exchangers and more particularly pertains to a new external reinforcement of connections between header tanks and tubes in heat exchangers for enhancing the ability of the connection between the tanks and tubes to resist stress imposed upon the juncture of these parts.

2. Description of the Prior Art

Heat exchangers are employed to exchange or transfer heat from a relatively higher temperature first fluid flow to a relatively lower temperature second fluid flow while maintaining the separate fluid flows. In many heat exchangers, the first fluid flow passes between a pair of tanks through a plurality of parallel tubes. The second fluid flow passes about the exterior of the tubes and fins that extend between the tubes to remove heat communicated from the first fluid flow to the tubes and the fins. The often significant difference in the temperatures of the fluids, in repeated periods of operation and non-operation, tends to stress the multitude of connections between the plurality of tubes and the tanks. The stresses of the thermal cycling may compromise the metallurgical bonds at the joints between the tubes and the tanks, as well as the strength of the parent material of the tubes themselves, which can lead to leaks of the first fluid flow into the second fluid flow.

SUMMARY

In view of the foregoing, the present disclosure describes a new external reinforcement of connections between header tanks and tubes in heat exchangers which may be utilized for enhancing the ability of the connection between the tanks and tubes to resist stress imposed upon the juncture of these parts, as well as upon the parts themselves.

In one aspect, the present disclosure relates to a heat exchanger having first and second sides and comprising a pair of tanks, with each of the tanks defining an interior and including a header. A plurality of openings is formed in the header. The heat exchanger also comprises a plurality of tubes extending between the openings of the tanks, with each of the tubes having opposite end portions joined to the tanks to fluidly connect the interiors of the tanks through interiors of the tubes. The heat exchanger also comprises at least one reinforcement ribbon element extending across a juncture between the header and the plurality of tubes to reinforce a connection between the header and the plurality of tubes.

In another aspect, the present disclosure relates to a heat exchanger having first and second sides and comprising a pair of tanks, with each of the tanks defining an interior and including a header. A plurality of openings is formed in the header. The heat exchanger also comprises a plurality of tubes extending between the openings of the tanks, with each of the tubes having opposite end portions joined to the tanks to fluidly connect the interiors of the tanks through interiors of the tubes. The heat exchanger further comprises a reinforcement ribbon element having a base strip bonded to at least a portion of an outward surface of the header and a plurality of reinforcing collars extending from the base strip and each being bonded to an exterior surface of one of the tubes. The ribbon element extends across a juncture between the header and the plurality of tubes to reinforce a connection between the header and the plurality of tubes.

In still another aspect, the present disclosure relates to a reinforcement ribbon element for reinforcing connections between a tank and a plurality of tubes of a heat exchanger. The ribbon element comprises an elongated base strip for positioning against a header of the tank. The base strip includes a plurality of intermediate portions, and the intermediate portions are substantially coplanar with each other in a first plane for abutting an outward surface of the header. The ribbon element also comprises a plurality of reinforcing collars for each receiving a portion of one of the tubes of the plurality of tubes. Each reinforcing collar extends from one of the intermediate portions of the base strip, and a portion of an exterior surface of the reinforcing collar is concave for abutting an exterior surface of one of the tubes.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
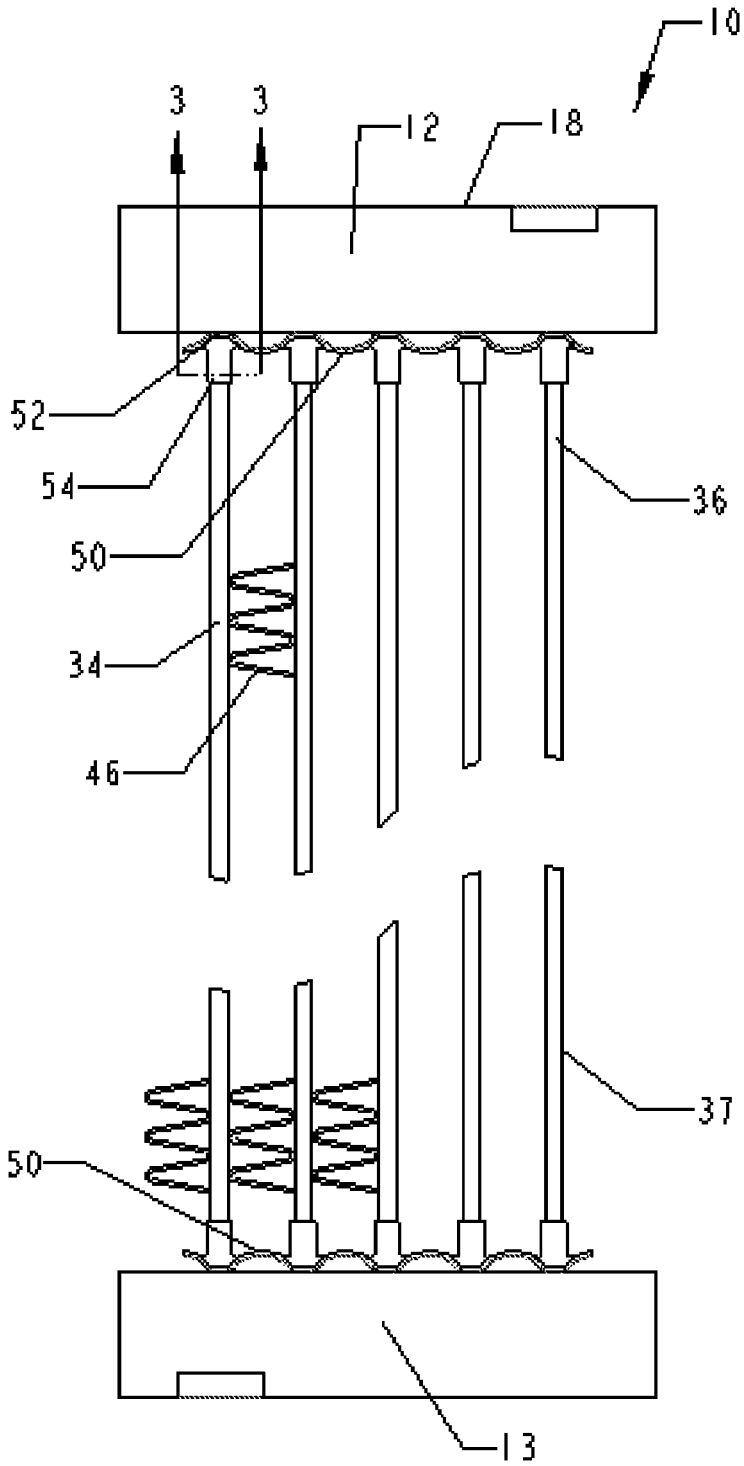
FIG. 1 is a schematic front view of a heat exchanger incorporating the new external reinforcement of connections between header tanks and tubes according to the present disclosure.
Figure 2:
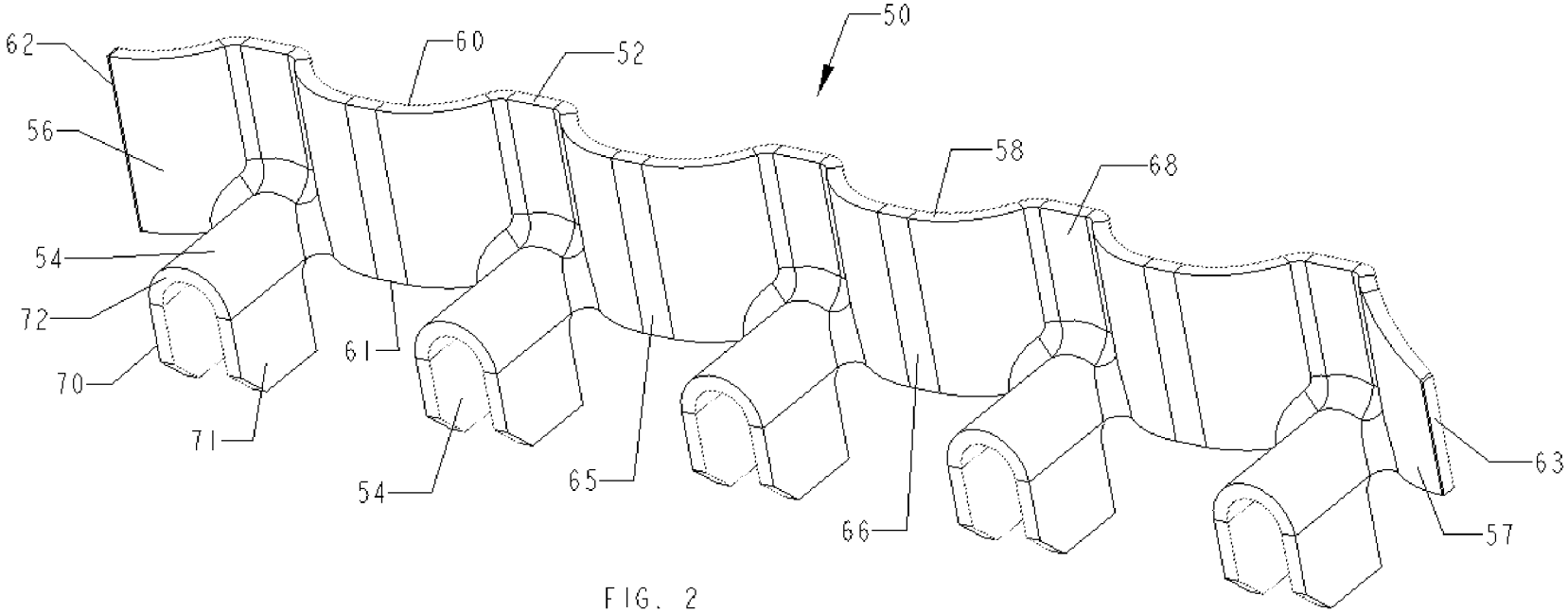
FIG. 2 is a schematic perspective view of the reinforcement ribbon element according to an illustrative embodiment, which is shown removed from the heat exchanger.
Figure 3:
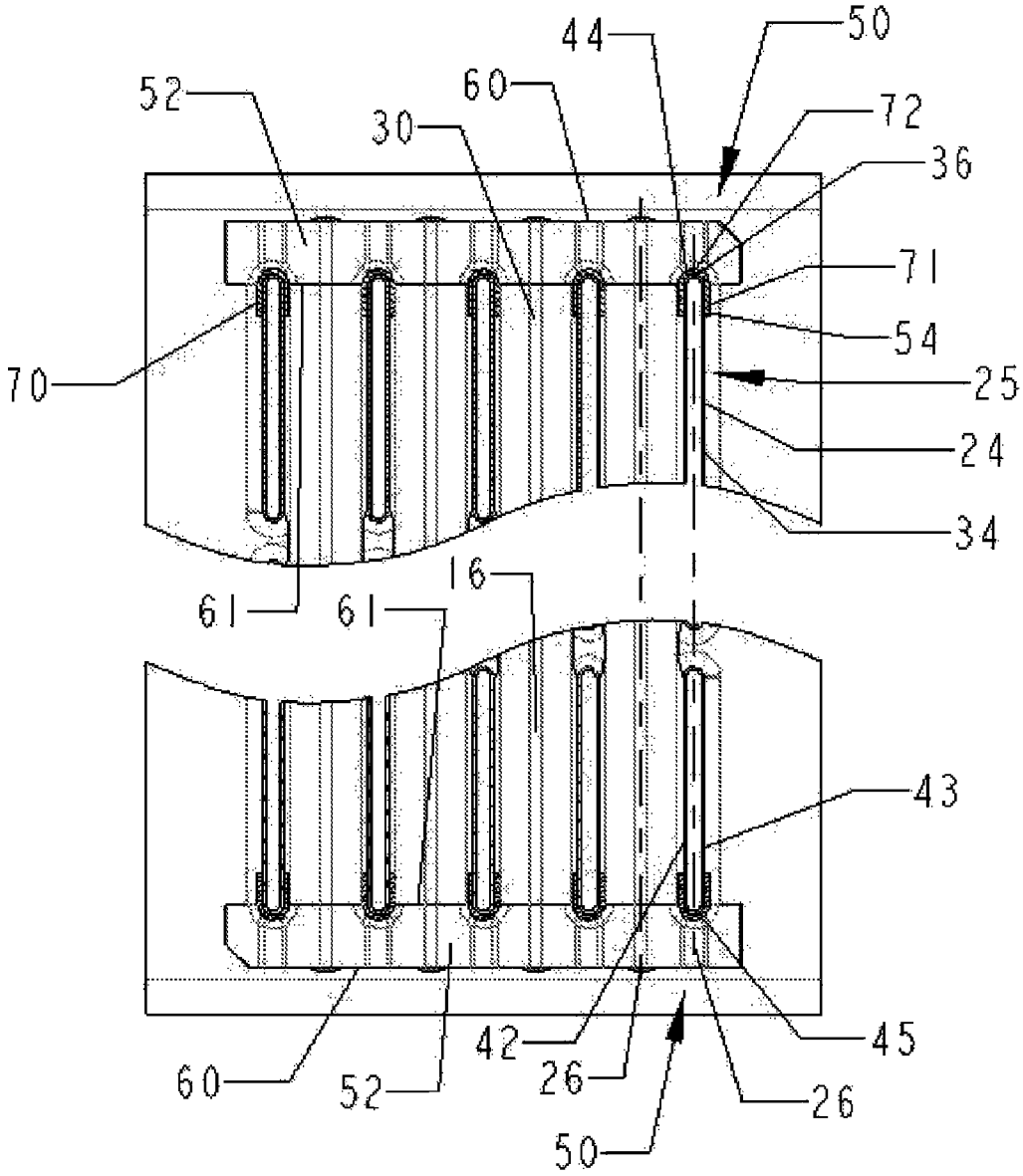
FIG. 3 is a schematic sectional view of a portion of the heat exchanger with the reinforcement ribbon element, which is taken along line 3-3 of FIG. 1.
Figure 4:
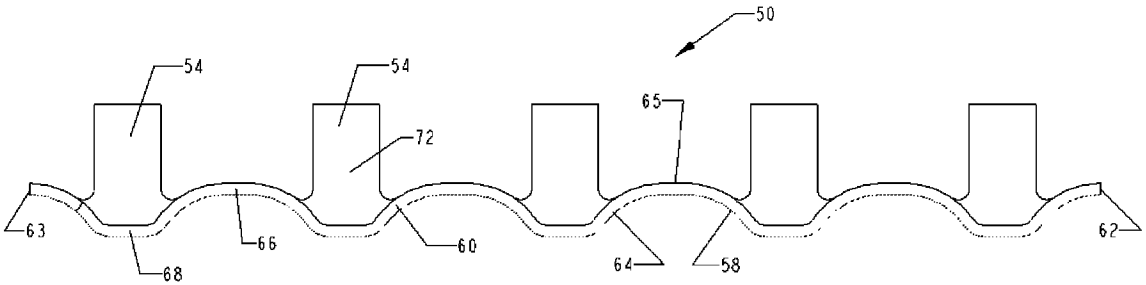
FIG. 4 is a schematic side view of the reinforcement ribbon element, according to an illustrative embodiment.
Figure 5:
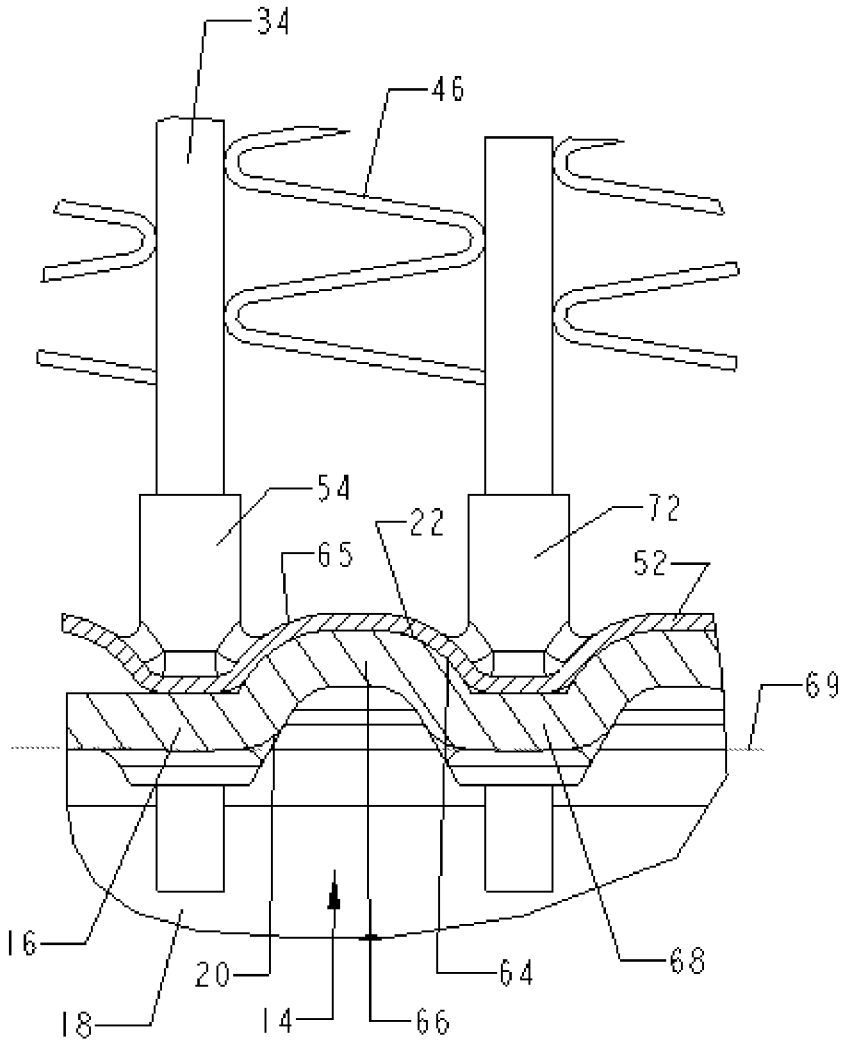
FIG. 5 is a schematic enlarged side view of a broken away portion of the reinforcement ribbon element.
Figure 6:
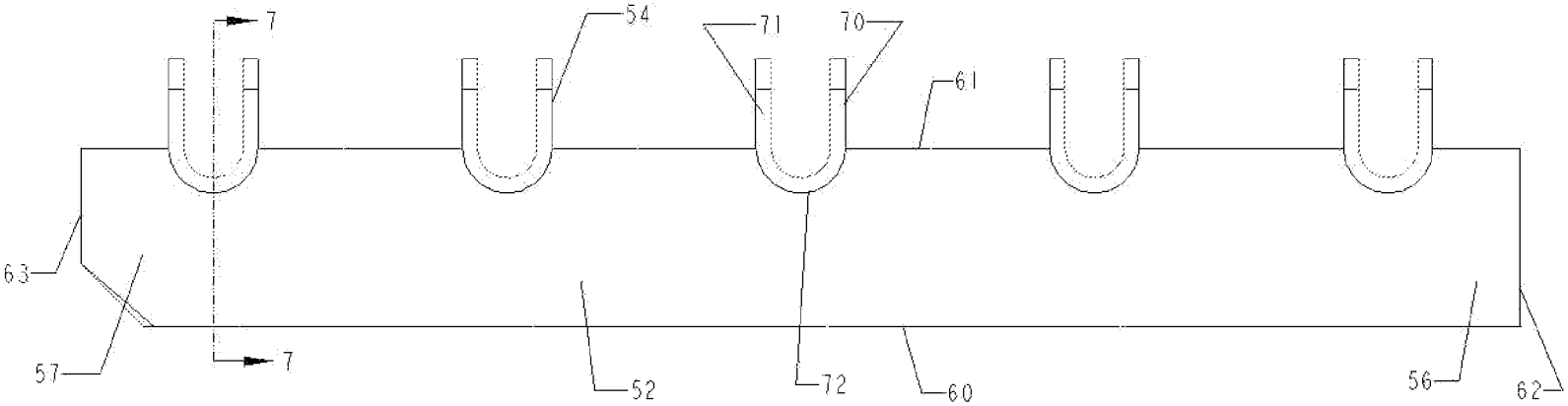
FIG. 6 is a schematic top view of the reinforcement ribbon element.
Figure 7:
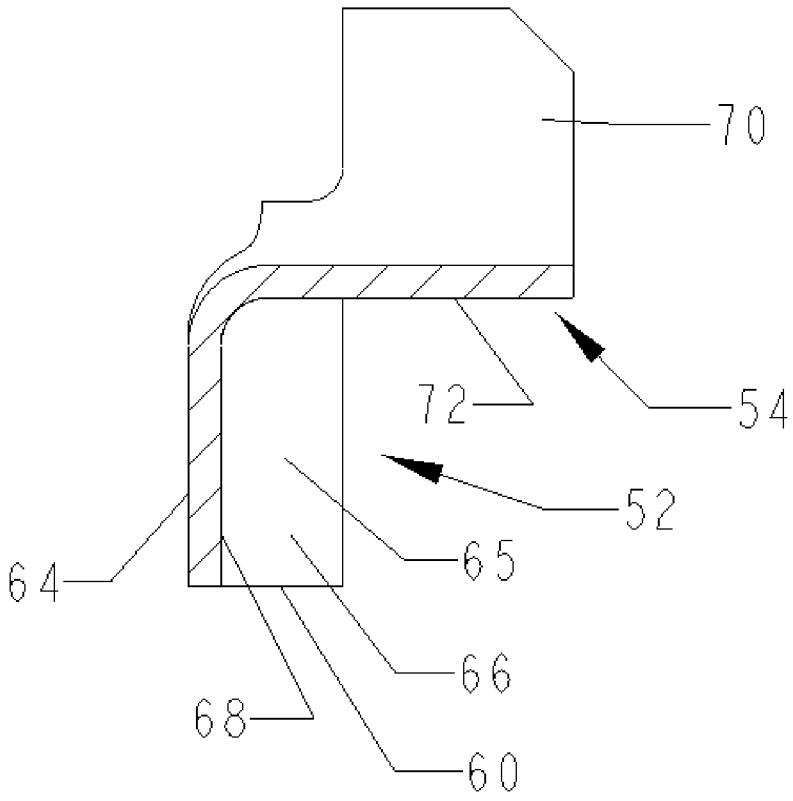
FIG. 7 is a schematic sectional view of a portion of the reinforcement ribbon element, which is taken along line 7-7 of FIG. 6.

With reference now to the drawings, and in particular to FIGS. 1 through 7 thereof, a new improvement implementing external reinforcement of connections between header tanks and tubes in heat exchangers embodying the principles and concepts of the disclosed subject matter will be described.

The disclosure relates to an improvement in heat exchangers in which heat is transmitted from a first fluid flow to a second fluid flow, such as, for example, a radiator heat exchanger in which the first fluid is a liquid and the second fluid is a gas, although the improvements may be utilized in other types of heat exchangers than the radiator used for illustrative purposes in this disclosure.

A suitable heat exchanger 10 may include a pair of tanks 12, 13 which may be spaced from each other, and each of which defines an interior 14 for receiving the first fluid via suitable connector structure on the tank that is not further described here. In the illustrative embodiments, the tanks 12, 13 may be of a two piece design, although the improvements may be used on single piece and multiple piece tanks. The tanks 12, 13 are typically of substantially identical design, and for the purposes of this description the tank 12 will be described with the understanding that the tank 13 is substantially identical, although identical structure for the tanks 12 and 13 is not critical to the invention.

Illustratively, each of the tanks 12, 13 may comprise a header or header plate 16 and a cover 18 mounted on the header plate to define the interior 14 of the tank. The header plate 16 and the cover 18 are typically elongated in a similar direction, with opposite sides and ends. The header plate 16 may be characterized by having an inward surface 20 for orienting toward the interior 14 of the tank 12, and an outward surface 22 for orienting away from the interior of the tank 12 and toward the opposite tank 13. The header plate 16 has at least one, and in most applications a plurality of, openings 24 formed therein. Each of the openings 24 may be located at an opening location 25 that is spaced or separated from the opening locations of other openings. The openings 24 may extend through and between the inward 20 and outward 22 surfaces of the header plate. Each of the openings 24 may be elongated in a first direction or along a first axis 26, which may be oriented substantially perpendicular to the direction of elongation of the header plate. Each opening 24 may have an elongated periphery, with the first axis 26 passing through the ends of the periphery.

In some embodiments, the header plate 16 may form a plurality of protruding ribs 30 that protrude with respect to the surrounding areas of the outward surface 22 that are otherwise substantially planar in character, and which may include the openings locations 25. Each of the ribs 30 may be located between adjacent openings 24 in the header plate 16, and each of the ribs may be elongated in a second direction or along a second axis 32. The second axis 32 of the ribs may be oriented substantially parallel to the first axis 26 of the elongation of the openings. The ribs 30 may protrude or extend outwardly toward the opposite tank 13. Each of the ribs 30 may comprise a domed area formed in the header plate, with each of the domed areas being convex at the outward surface 22 of the header plate and being convex at the inward surface 24. The ribs 30 may provide a rigidifying effect on the header plate of the tank.

The heat exchanger 10 may further include a plurality of tubes 34 that extend between the openings 24 of the tanks 12, 13 and fluidly connect the interiors 14 of the tanks through the interiors of the tubes. Each of the tubes has opposite end portions 36, 37 that are each joined to a respective one of the tanks 12, 13 at junctures 38. The end portions 36, 37 of the tubes may be mounted on the header plates of the respective tanks, and may be inserted into one of the openings 24 of the header plate 16. The end portions 36, 37 may be brazed to the header plate 16 about the periphery of the opening to create a fluid tight connection.

Although not critical to the improvement, the tubes 34 may have a flattened character such that a cross section of the tubes has an elongated circular, oval, or oblong shape, and the openings 24 may have a similar shape and size as the end portions 36, 37 of the tubes. Each of the tubes 34 has an exterior surface 40, with a pair of broad side exterior surfaces 42, 43 and a pair of narrower end exterior surfaces 44, 45. The side exterior surface 42, 43 may be substantially planar or have a relatively large radius of curvature, while the end exterior surfaces may be substantially semi-cylindrical or have a relatively small radius of curvature. In some embodiments, fins 46 may be positioned between the tubes 34 to form a core of the heat exchanger, and the fins may have a substantially serpentine shape that contacts both of the adjacent tubes.

A highly significant feature of the improved heat exchanger is at least one juncture reinforcement ribbon element 50 that extends adjacent to and along the junctures 38 of the tubes with one of the tanks 12. In some preferred embodiments, a ribbon element 50 is located at each of the tanks 12, 13, and at both sides of the core so that a heat exchanger may utilize four of the ribbon elements 50. In such embodiments, a pair of the ribbon elements 50 is mounted on the header plate 16 of each tank 12, 13, and a pair of the ribbon elements engages each end portion of a tube 34. In applications where the core includes more than one row of tubes in the depth direction of the core, as well as a plurality of tubes in the width direction, the ribbon element 50 may be employed on the outermost rows located at the front and rear of the core. Further, not all tubes across the front or rear of the core are necessarily engaged by the ribbon element 50, although engagement of all tubes is advantageous. One of the ribbon elements 50 will be described with the understanding that the other ribbon elements may have a substantially identical configuration.

The ribbon element 50 may extend along the outward surface 22 of the respective header plate 16, and may be positioned against and in abutment with at least a portion of the outward surface 22. The ribbon element 50 may be metallurgically connected to the header plate 16, such as by being brazed to the outward surface of the header plate. The ribbon element 50 may also be connected by brazing or other suitable metallurgical connection to the exterior surface of the end portions 36 of the tubes 34. In this way, there is a direct connection of the ribbon element 50 to the header plate 16 and to the tubes 34, and the connections are located outside of the tank 12, and outside of the interiors of the tubes.

The ribbon element 50 may be elongated in character, and the longitudinal direction of the element 50 may be generally oriented parallel to the longitudinal axis of the header plate 16. The length of the ribbon element 50 may be increased or decreased to accommodate the size of the array and extent of the tubes connected to the header plate at the juncture. The ribbon element 50 may be formed, such as by punching and pressing, from a single sheet of material of substantially uniform thickness, although this is not a critical requirement.

Also, the material forming the ribbon element may have a coating of a brazing material that may be melted to form the connection between the element and the tank and the tubes during exchanger formation, although again this is not necessary. In some of the more preferred embodiments, the ribbon element is formed of aluminum or an aluminum alloy, although other materials may be employed.

In greater detail, some embodiments of the juncture reinforcement ribbon element 50 comprise a base strip 52 and at least one reinforcing collar 54, although most implementations of the ribbon element 50 include a plurality of the collars 54. The base strip 52 may extend along the outward surface 22 of the header plate 16. The reinforcing collars 54 may each engage the exterior of a tube 34 of the plurality of tubes of the core.

The base strip may have opposite ends 56, 57, and a perimeter edge 58 with side sections 60, 61 of the edge and end sections 62, 63 of the edge. The perimeter edge 58 may generally define a uniform width between the end sections 62, 63 of the perimeter. The base strip 52 may also include an inner face 64 that is oriented toward the header plate, and an outer face 65 that is oriented outwardly away from the header plate.

The base strip 52 may include a plurality of arched portions 66, with each of the arched portions accommodating one of the protruding ribs 30 on the outward surface 22 of the header plate 16. Each of the ribs 30 of the header plate 16 may thus extend into one of the concave arched portions 66. The arched portions 66 may have opposite concave and convex portions of the inner 64 and outer 65 faces, and may extend from one side section 60 of the perimeter edge 58 to the other side section 61. In some embodiments, partial or incomplete arched portions may be located at the opposite ends of the base strip. Additionally, the base strip 52 may also include a plurality of intermediate portions 68 that may be positioned between the adjacent arched portions 66, so that the intermediate portions separate the arched portions and similarly, the arched portions separate the intermediate portions. The intermediate portions 68 may be substantially coplanar with each other in a first plane 69.

The reinforcing collars 54 may extend from the base strip 52, and may extend toward the tank 13 located opposite of the tank 12 on which the particular reinforcing ribbon 50 is mounted, and the ribbon elements mounted on the tank 13 may extend toward the tank 12. The reinforcing collars 54 may extend in a direction that is substantially perpendicular to a plane of the intermediate portions 68 of the base strip 52. The reinforcing collars 54 may also extend in a lateral direction from the base strip 52 beyond the perimeter edge 58. The reinforcing collars 54 may be spaced from each other in a longitudinal direction of the ribbon element 50. The reinforcing collars 54 may extend from the base strip 52 at locations or positions that correspond to the locations of the tubes and the opening locations 25 on the header plate.

In greater detail, each of the reinforcing collars 54 may be generally U-shaped to embrace a portion of the exterior surface 40 of one of the tubes. Each of the reinforcing collars 54 may comprise a pair of ear portions 70, 71 that extend along a portion of the exterior surface 40 on opposite sides of the tube 34. The ear portions 70, 71 may extend in substantially parallel planes to each other, although the orientation of the side exterior surfaces 42, 43 of the tubes may govern the particular orientations of the ear portions 70, 71. Each of the reinforcing collars 54 may also comprise a bridge portion 72 that extends between the ear portions 70, 71. The bridge portion 72 may be connected to the base strip 52 at a location on the base strip between the arched portions 66, and may be connected to the intermediate portion 68 of the base strip 52. The bridge portion 72 may be substantially semi-cylindrical in shape to correspond with the end exterior surface 44, 45 of the tube.

It will be recognized in light of the above that the disclosed improvement in heat exchangers provides an external reinforcement of the connection between the tanks and tubes of the heat exchanger with an element that bridges the juncture between the tank and tubes, and does not interfere with or negatively influence the internal flow of the fluid through the tubes and the tanks. The external positioning of the reinforcement element of the disclosure may also permit the use of a larger element than, for example, elements that are positioned internally, particularly if the internal element is not to restrict fluid flow. The external positioning of the reinforcement element also permits the areas of header plate and the tubes that are engaged by and bonded to the element to be relatively large to enhance the bond between the element and the tank and tubes.

Further, in heat exchangers in which the parts are brazed together while the tubes are substantially horizontal orientations (e.g., with the heat exchanger laid on its front or rear face), the fillets formed by the brazing material may be relatively smaller on the top or uppermost sides of the tubes and relatively larger on the bottom or lowermost sides of the tubes, due to the effect of gravity, etc. on the fluid brazing material. It may thus be desirable to apply the ribbon element 50 to the top sides of the tubes to further reinforce the locations where the fillets of brazing material may be relatively smaller, and omit the ribbon element from the bottom sides of the tubes.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A reinforcement ribbon element for reinforcing connections between a tank and a plurality of tubes of a heat exchanger, the ribbon element comprising:

an elongated base strip for positioning against a header of the tank, the base strip including a plurality of intermediate portions, the intermediate portions being substantially coplanar with each other in a first plane for abutting an outward surface of the header; and a plurality of reinforcing collars for each receiving a portion of one of the tubes of the plurality of tubes, each reinforcing collar extending from one of the intermediate portions of the base strip;

wherein each of the reinforcing collars defines a throat and comprises a pair of ear portions defining sides of the throat for extending along a portion of the exterior surface on side sections of the tube and a bridge portion extending between the ear portions and defining a closed end to the throat for positioning adjacent to an end section of the tube between the side sections, the bridge portion being connected to the base strip;

wherein the ear portions of a said reinforcing collar have inner surfaces oriented substantially perpendicular to the first plane of the base strip and positioned in opposition to each other to form a gap therebetween, the inner surfaces extending from the bridge portion to a mouth defined by free end edges of the ear portions located opposite of the bridge portion, the inner surfaces extending in planes oriented substantially parallel to each other so that the throat has a substantially uniform width from the mouth to the bridge portion;

wherein the base strip includes an arched portion curved about a first axis and wherein the bridge portion of a said reinforcing collar curves about a second axis, and wherein the first and second axes are oriented substantially perpendicular to each other.

2. The reinforcement ribbon element of claim 1 wherein the base strip further comprises a plurality of arched portions located in an alternating manner with the intermediate portions, the arched portions including opposite concave and convex faces.

3. The reinforcement ribbon element of claim 2 wherein the base strip includes alternating arched portions and substantially planar intermediate portions.

4. The reinforcement ribbon element of claim 3 wherein the arched portions of the base strip and the reinforcing collars extend in a same direction with respect to the first plane.

5. The reinforcement ribbon element of claim 2 wherein the bridge portion of each reinforcing collar is connected to a said intermediate portion of the base strip between the arched portions.

6. The reinforcement ribbon element of claim 5 wherein the bridge portions are substantially semi-cylindrical in shape.

7. The reinforcement ribbon element of claim 1 wherein the reinforcing collars are substantially U-shaped.

8. The reinforcement ribbon element of claim 1 wherein the base strip has a substantially rectangular perimeter edge, and the reinforcing collars extend from one side section of the perimeter edge.

9. The reinforcement ribbon element of claim 1 wherein the base strip and plurality of reinforcing collars are formed by single piece of substantially uniformly thick sheet material.

10. The reinforcement ribbon element of claim 1 wherein a maximum width of the throat does not exceed the width at the free edges.

11. The reinforcement ribbon element of claim 1 wherein the base strip has a perimeter edge with side sections and end sections, and the ear portions of the reinforcing collars extend beyond one of the side sections of the perimeter edge.

12. A reinforcement ribbon element for reinforcing connections between a tank and a plurality of tubes of a heat exchanger, the ribbon element comprising:

an elongated base strip for positioning against an outward surface of a header of the tank, the base strip including a plurality of intermediate portions and a plurality of arched portions, the arched portions and the intermediate portions being arranged in an alternating manner along the base strip, and the intermediate portions being substantially planar and being coplanar with each other in a first plane and the arched portions being curved out of the first plane; and a plurality of reinforcing collars for each receiving a portion of one of the tubes of the plurality of tubes, each reinforcing collar extending from one of the intermediate portions of the base strip;

wherein each of the reinforcing collars defines a throat and comprises a pair of ear portions defining sides of the throat for extending along a portion of the exterior surface on side sections of the tube and a bridge portion extending between the ear portions and defining a closed end to the throat for positioning adjacent to an end section of the tube between the side sections, the bridge portion being connected to the base strip;

wherein the ear portions of a said reinforcing collar have inner surfaces oriented substantially perpendicular to the first plane of the base strip and positioned in opposition to each other to form a gap therebetween, the inner surfaces extending from the bridge portion to a mouth defined by free end edges of the ear portions located opposite of the bridge portion, the inner surfaces extending in planes oriented substantially parallel to each other so that the throat has a substantially uniform width from the mouth to the bridge portion;

wherein the base strip includes a said arched portion curved about a first axis and wherein the bridge portion of a said reinforcing collar curves about a second axis, and wherein the first and second axes are oriented substantially perpendicular to each other.

13. The reinforcement ribbon element of claim 12 wherein the reinforcing collars are substantially U-shaped.

14. The reinforcement ribbon element of claim 12 wherein the base strip has a substantially rectangular perimeter edge, and the reinforcing collars extend from one side section of the perimeter edge.

15. The reinforcement ribbon element of claim 12 wherein the arched portions of the base strip and the reinforcing collars extend in a same direction with respect to the first plane.

16. The reinforcement ribbon element of claim 12 wherein the base strip and plurality of reinforcing collars are formed by single piece of substantially uniformly thick sheet material.

17. The reinforcement ribbon element of claim 12 wherein the reinforcing collars are spaced from each other in a longitudinal direction of the base strip.

18. The reinforcement ribbon element of claim 12 wherein the bridge portion of each reinforcing collar is connected to a said intermediate portion of the base strip between the arched portions.

* * * * *